US007900639B2

(12) United States Patent
Perfetti et al.

(10) Patent No.: US 7,900,639 B2
(45) Date of Patent: Mar. 8, 2011

(54) RECONSTITUTED TOBACCOS CONTAINING ADDITIVE MATERIALS

(75) Inventors: Thomas Albert Perfetti, Winston-Salem, NC (US); Curtis Dillard McGee, Jr., Germanton, NC (US); James Fitzgerald Best, Jr., Winston-Salem, NC (US); Paul Andrew Brinkley, Winston-Salem, NC (US); Sharon Pitts Dunlap, Walnut Cove, NC (US); Charles Hugh Risner, High Point, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 505 days.

(21) Appl. No.: 11/623,870

(22) Filed: Jan. 17, 2007

(65) Prior Publication Data

US 2007/0107743 A1 May 17, 2007

Related U.S. Application Data

(63) Continuation of application No. 10/463,211, filed on Jun. 17, 2003, now abandoned.

(51) Int. Cl.

| | |
|---|---|
| ***A24B 3/14*** | (2006.01) |
| ***A24B 15/12*** | (2006.01) |
| ***A24B 1/00*** | (2006.01) |

(52) U.S. Cl. ..... 131/353; 131/360; 131/370; 131/372

(58) Field of Classification Search ..... 131/290–310, 131/360–372

See application file for complete search history.

(56) References Cited

U.S. PATENT DOCUMENTS 2,832,351 A 4/1958 Hale (Continued)

FOREIGN PATENT DOCUMENTS

CN 1068486 A 2/1993

(Continued)

OTHER PUBLICATIONS

Bagchi, D et al. "Protective Effects of Free Radical Scavengers and Antioxidants Against Smokeless Tobacco Extract (STE)-Induced Oxidative Stress in Macrophage J774A.1 Cell Cultures" Archives of Environmental Contamination and Toxicology. Springer-verlag New York Inc. 1995. viewed on Apr. 15, 2009 at http://www.springerlink.com/content/t7067j56523u8l61.*

(Continued)

*Primary Examiner* — Jason L Lazorcik
*Assistant Examiner* — Jodi Cohen
(74) *Attorney, Agent, or Firm* — Womble Carlyle Sandridge & Rice, PLLC

(57) ABSTRACT

A reconstituted tobacco material incorporates an exogenous tocopherol or derivative thereof, such as in the amount of at least about 0.1 weight percent. A tobacco blend can be formed by combining reconstituted tobacco material incorporating such an additive with one or more additional tobacco materials, such as burley tobacco, Oriental tobacco, and flue-cured tobacco. A smoking article, such as a cigarette, contains such a reconstituted tobacco, as part of the smokable material, as part of tobacco paper wrapping material, or as part of a reconstituted tobacco-containing filter element. The invention also provides a method of forming reconstituted tobacco material wherein a tocopherol or derivative thereof is added to the tobacco material, either by adding the tocopherol to an aqueous extract or water insoluble pulp formed during the reconstituted tobacco process or by adding the tocopherol to the solid reconstituted tobacco sheet after the aqueous extract and pulp are recombined.

18 Claims, 1 Drawing Sheet

U.S. PATENT DOCUMENTS

| | | | | | |
|---|---|---|---|---|---|
| 3,339,558 | A | | 9/1967 | Waterbury | |
| 3,353,541 | A | | 11/1967 | Hind et al. | |
| 3,398,754 | A | | 8/1968 | Tughan | |
| 3,483,874 | A | | 12/1969 | Hind | |
| 3,525,582 | A | | 8/1970 | Waterbury | |
| 3,667,478 | A | | 6/1972 | Waterbury | |
| 3,760,815 | A | | 9/1973 | Deszyck | |
| 3,844,294 | A | | 10/1974 | Webster | |
| 3,847,164 | A | | 11/1974 | Mattina et al. | |
| 3,897,793 | A | | 8/1975 | Webster | |
| 3,958,580 | A | | 5/1976 | Mergens et al. | |
| 4,131,117 | A | | 12/1978 | Kite et al. | |
| 4,270,552 | A | | 6/1981 | Jenkins et al. | |
| 4,308,877 | A | | 1/1982 | Mattina | |
| 4,341,228 | A | | 7/1982 | Keritsis et al. | |
| 4,421,126 | A | | 12/1983 | Gellatly | |
| 4,516,588 | A | | 5/1985 | Rudolph et al. | |
| 4,657,032 | A | | 4/1987 | Dorr et al. | |
| 4,674,519 | A | | 6/1987 | Keritsis et al. | |
| 4,706,692 | A | | 11/1987 | Gellatly | |
| 4,753,250 | A | | 6/1988 | Bitter et al. | |
| 4,880,018 | A | | 11/1989 | Graves, Jr. et al. | |
| 4,941,484 | A | | 7/1990 | Clapp et al. | |
| 4,962,774 | A | | 10/1990 | Thomasson et al. | |
| 4,972,854 | A | | 11/1990 | Kiernan et al. | |
| 4,987,906 | A | | 1/1991 | Young et al. | |
| 5,003,995 | A | | 4/1991 | Kersey | |
| 5,016,655 | A | * | 5/1991 | Waddell et al. | 131/310 |
| 5,025,812 | A | | 6/1991 | Fagg et al. | |
| 5,056,537 | A | | 10/1991 | Brown et al. | |
| 5,065,775 | A | | 11/1991 | Fagg | |
| 5,072,744 | A | | 12/1991 | Luke et al. | |
| 5,099,864 | A | | 3/1992 | Young et al. | |
| 5,101,839 | A | | 4/1992 | Jakob et al. | |
| 5,131,414 | A | | 7/1992 | Fagg et al. | |
| 5,143,097 | A | | 9/1992 | Sohn et al. | |
| 5,159,942 | A | | 11/1992 | Brinkley et al. | |
| 5,203,354 | A | | 4/1993 | Hickle | |
| 5,234,008 | A | | 8/1993 | Fagg | |
| 5,308,874 | A | | 5/1994 | Sanchez et al. | |
| 5,325,877 | A | | 7/1994 | Young et al. | |
| 5,327,917 | A | | 7/1994 | Lekwauwa et al. | |
| 5,339,838 | A | | 8/1994 | Young et al. | |
| 5,360,022 | A | | 11/1994 | Newton et al. | |
| 5,445,169 | A | | 8/1995 | Brinkley et al. | |
| 5,501,237 | A | * | 3/1996 | Young et al. | 131/297 |
| 5,533,530 | A | | 7/1996 | Young et al. | |
| 5,715,844 | A | | 2/1998 | Young et al. | |
| 5,724,998 | A | | 3/1998 | Gellatly et al. | |
| 5,829,449 | A | | 11/1998 | Hersh et al. | |
| 5,829,453 | A | | 11/1998 | White et al. | |
| 5,944,026 | A | | 8/1999 | Kopsch et al. | |
| 6,079,418 | A | | 6/2000 | Russo | |
| 6,082,370 | A | | 7/2000 | Russo | |
| 6,182,670 | B1 | | 2/2001 | White et al. | |
| 6,216,706 | B1 | | 4/2001 | Kumar et al. | |
| 6,584,979 | B2 | | 7/2003 | Xue et al. | |
| 6,584,980 | B1 | * | 7/2003 | Russo | 131/347 |
| 6,845,777 | B2 | * | 1/2005 | Pera | 131/270 |
| 2002/0074009 | A1 | | 6/2002 | Zhao et al. | |
| 2002/0117180 | A1 | * | 8/2002 | Hersh et al. | 131/359 |

FOREIGN PATENT DOCUMENTS

| | | | |
|---|---|---|---|
| EP | 0 003 064 | A2 | 7/1979 |
| EP | 0 565 360 | A2 | 10/1993 |
| EP | 1 055 375 | A2 | 11/2000 |
| WO | WO 95/28098 | A1 | 10/1995 |
| WO | WO 98/01233 | A1 | 1/1998 |
| WO | WO 03/053179 | A1 | 7/2003 |

OTHER PUBLICATIONS

Risner, "The Determination of +α-Tocopherol in Tobacco and Mainstream Tobacco Smoke", *Tobacco Science*, 1997, pp. 53-61.

Fiume, "Final Report on the Safety Assessment of Tocopherol, Tocopheryl Acetate, Tocopheryl Linoleate, Tocopheryl Linolcate/Oleate, Tocopheryl Nicotinate, Tocopheryl Succinate, Dioleyl Tocopheryl Methylsilanol, Potassium Ascorbyl Tocopheryl Phosphate, and Tocophersolan", *Int. J. Toxicol.*, 2002, pp. 51-116, vol. 21.

* cited by examiner

RECONSTITUTED TOBACCOS CONTAINING ADDITIVE MATERIALS

CROSS-REFERENCE TO RELATED APPLICATIONS

The present application is a continuation of application Ser. No. 10/463,211, filed Jun. 17, 2003 now abandoned, which is incorporated herein by reference in its entirety and for all purposes.

FIELD OF THE INVENTION

The present invention relates to tobacco, and in particular to processed tobaccos, such as reconstituted tobaccos, and to the use of processed tobaccos in tobacco products, such as smoking articles (e.g., cigarettes).

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in *Tobacco Production, Chemistry and Technology*, Davis et al. (Eds.) 1999. A cigarette is employed by a smoker by lighting one end thereof and burning the tobacco rod. The smoker then receives mainstream smoke into his/her mouth by drawing on the opposite end (e.g., the filter end) of the cigarette.

It has been suggested to incorporate certain additives into cigarettes in order to improve certain properties of those cigarettes. See, for example, U.S. Pat. No. 3,525,582 to Waterbury; U.S. Pat. No. 3,958,580 to Mergens et al.; U.S. Pat. No. 5,016,655 to Waddell et al.; U.S. Pat. No. 6,082,370 to Russo; and PCT WO 95/28098 and CN 1068486A. It has been suggested that such additives, such as certain vitamins, can be incorporated into smoking articles in a variety of ways, such as by incorporating the additive into a tobacco substitute. See, for example, U.S. Pat. No. 3,844,294 to Webster; U.S. Pat. No. 3,897,793 to Webster; U.S. Pat. No. 4,516,588 to Rudolph et al. and U.S. Pat. No. 5,003,995 to Kersey. It also has been suggested that certain additives can be incorporated into cigarette filters or mouthend pieces. See, for example, U.S. Pat. No. 2,832,351 to Hale; U.S. Pat. No. 3,339,558 to Waterbury; U.S. Pat. No. 3,667,478 to Waterbury; U.S. Pat. No. 4,657,032 to Dorr et al; and U.S. Pat. No. 4,753,250 to Bitter et al.; and EPO 0003064.

There remains a need in the art for methods of improving the properties of smoking articles, such as cigarettes, by incorporating additives capable of altering the properties of the smoking article in a beneficial manner. Thus, it would be desirable to provide a manufacturer of tobacco products with an efficient and effective manner or method to produce a processed tobacco material that incorporates certain additives.

SUMMARY OF THE INVENTION

The present invention, in one aspect, relates to a reconstituted tobacco material comprising at least one exogenous tocopherol or derivative thereof. Preferably, the reconstituted tobacco has incorporated therein at least about 0.1% exogenous tocopherol compound, based on the dry weight of that reconstituted tobacco. As such, the present invention provides a method for producing a reconstituted tobacco material, which method involves adding at least one tocopherol compound to the tobacco material. The additive can be incorporated into the reconstituted tobacco material during the manufacture of that tobacco material, or can be applied to the reconstituted tobacco material after production of that tobacco material is complete. The additive can be incorporated into an aqueous slurry formed for the purpose of reconstituted tobacco manufacture. The additive can be added to the aqueous extract or to the water insoluble pulp that formed during the paper-making type of reconstituted tobacco production process. The additive can be added to the reconstituted tobacco material formed after formation of a cast sheet, or after recombination of an aqueous tobacco extract and the water insoluble tobacco pulp. The additive can be applied as a casing or top dressing to a formed reconstituted tobacco material. When the additive is combined with a formed reconstituted tobacco, the reconstituted tobacco can be a component of a tobacco blend, and the additive can be added to certain or all of the components of that blend. For example, additive can be applied to a tobacco blend during cigarette manufacture.

The present invention, in another aspect, relates to manners or methods for treating extracts of tobacco, and in particular, aqueous extracts of tobacco. The addition of at least tocopherol or derivative thereof an aqueous tobacco extract, such as an aqueous tobacco extract or an aqueous slurry formed during reconstituted tobacco material manufacture, results in an increase in the usable storage life of the tobacco extract. That is, incorporation of tocopherol compounds in an aqueous tobacco extract results in inhibition of fermentation processes and inhibition in the formation of molds within that extract.

The present invention, in another aspect, relates to a tobacco product incorporating, as a component thereof, a reconstituted tobacco of the present invention. The tobacco product can be a smokeless product, but most preferably, the tobacco product is a smoking article. In one preferred regard, the present invention provides a tobacco blend suitable for use as the smokable material in a smoking article, such as a cigarette. The tobacco blend of the invention comprises a reconstituted tobacco material provided in accordance with to the invention, and most preferably incorporates one or more additional tobacco materials, such as burley tobacco, flue-cured tobacco, and Oriental tobacco. In another preferred regard, the present invention relates to smoking articles, such as cigarettes, that are manufactured using a reconstituted tobacco of the present invention. For example, the reconstituted tobacco most preferably is used as a component of a smokable tobacco blend of a smoking article, such as a cigarette.

BRIEF DESCRIPTION OF THE DRAWINGS

Figure 1:
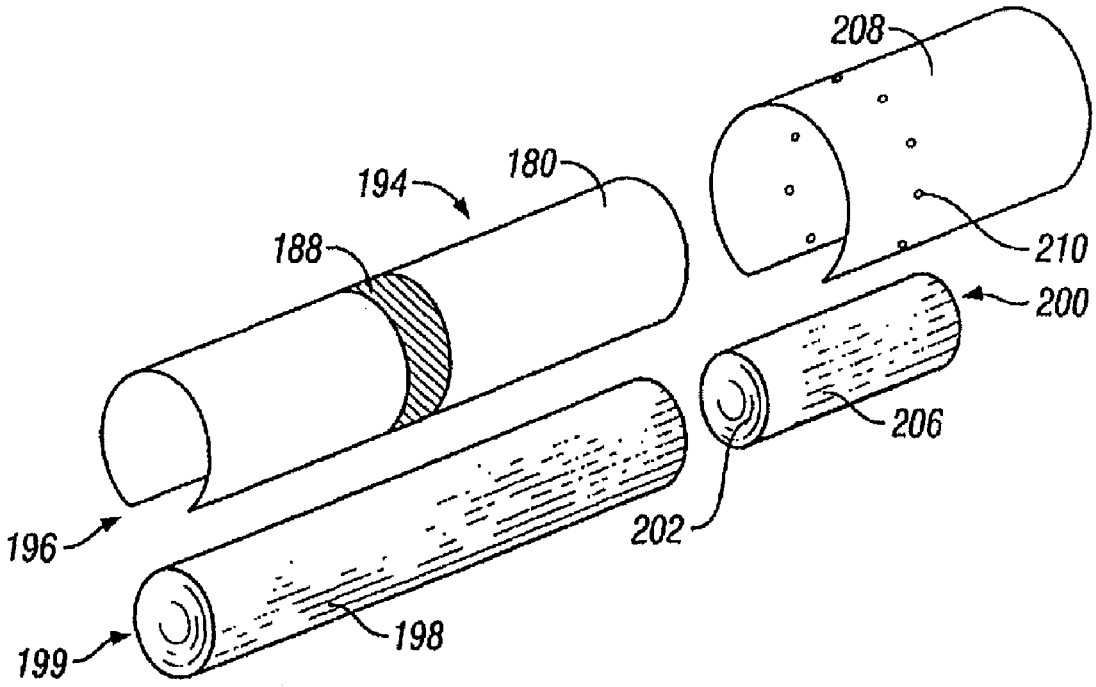

Having thus described the invention in general terms, reference will now be made to the accompanying drawing, which is not necessarily drawn to scale and wherein:

FIG. 1 is an exploded perspective of smoking article, showing the smokable material, the wrapping material components, and the filter element.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art.

The reconstituted tobacco materials of the invention can be components of a wide variety of tobacco products; but most preferably, those tobacco materials are incorporated into smoking articles, such as cigarettes. A typical cigarette known in the art is illustrated in FIG. 1. Referring to FIG. 1, a smoking article 194 in the form of a cigarette is shown. The cigarette 194 includes a generally cylindrical rod 196 of a charge or roll of smokable filler material 198 contained in a circumscribing wrapping material 180 of the present invention. The rod 196 is conventionally referred to as a "tobacco rod". The ends of the tobacco rod are open to expose the smokable filler material. At one end of the tobacco rod 196 is the lighting end 199, and at the other end is shown a filter element 200. The cigarette 194 is shown as having one optional printed band 188 on printed wrapping material 180, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) or on the outer surface of the wrapping material. Although the cigarette shown in FIG. 1 possesses wrapping material having one optional band, the cigarette also can possess wrapping material having further optional spaced bands numbering two, three, or more.

The cigarette 194 normally includes a filter element 200 or other suitable mouthpiece positioned adjacent one end of the tobacco rod 196 such that the filter element and tobacco rod are axially aligned in an end-to-end relationship, preferably abutting one another. Filter element 200 has a generally cylindrical shape, and the diameter thereof is essentially equal to the diameter of the tobacco rod. The ends of the filter element are open to permit the passage of air and smoke therethrough. The filter element 200 includes filter material 202 (e.g., plasticized cellulose acetate tow) that is overwrapped along the longitudinally extending surface thereof with circumscribing plug wrap material 206. A typical plug wrap material 206 is a paper material, such as a paper that his highly porous to air flow. The filter element 200 can have two or more filter segments, and/or flavor additives incorporated therein.

The filter element 200 is attached to the tobacco rod 196 by tipping material 208, which circumscribes both the entire length of the filter element and an adjacent region of the tobacco rod. The inner surface of the tipping material 208 is fixedly secured to the outer surface of the plug wrap 206 and the outer surface of the wrapping material 180 of the tobacco rod, using a suitable adhesive. A ventilated or air diluted smoking article is provided with an air dilution means, such as a series of perforations 210, each of which extend through the tipping material and plug wrap.

The tobacco rod 196, the filter element 200 and the cigarette 194 resulting from the combination thereof can be manufactured using conventional cigarette and cigarette component manufacturing techniques and equipment, without any extensive modification, if any, to those conventional techniques and equipment. Manners and methods suitable for the commercial production of cigarettes of the present invention will be readily apparent to those skilled in the art of cigarette manufacture.

Tobacco materials useful for carrying out the present invention can vary. Tobacco materials, including reconstituted tobacco materials, can be derived from various types of tobacco, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled stems, cut-rolled-expanded stems or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). Tobacco reconstitution processes traditionally convert portions of tobacco that normally might be wasted into commercially useful forms. For example, tobacco stems, pieces of tobacco scrap and tobacco dust can be used to manufacture reconstituted tobaccos of fairly uniform consistency. The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999). It is highly preferred that 100% of the smokable material within the cigarette be composed of tobacco of some form. Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; U.S. Pat. Application 2002/0000235 to Shafer et al.; PCT WO 02/37990; U.S. patent application Ser. No. 10/285,395, filed Oct. 31, 2002; and Bombick et al., *Fund. Appl. Toxicol.,* 39, p. 11-17 (1997). Reconstituted tobacco materials of the invention can be incorporated into various blends of tobacco, including American blends, for use as the smokable material in smoking articles, such as cigarettes.

The tobacco materials of the invention are typically used in forms, and in manners, that are traditional for the manufacture of smoking articles, such as cigarettes. The tobacco for cigarette blends normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.6 g to about 1 g. The tobacco filler normally is employed so as to fill the tobacco rod of a cigarette at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

The wrapping material of the tobacco rod can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; and U.S. patent application Ser. No. 10/303,648, filed Nov. 25, 2002; Ser. No. 10/324,418, filed Dec. 20, 2002 and Ser. No. 10/440,290, filed May 16, 2003; which are incorporated herein by reference in their entireties.

The filter element can vary. Representative filter element components and designs are described in Browne, *The Design of Cigarettes*, 3rd Ed. (1990); *Tobacco Production, Chemistry and Technology*, Davis et al. (Eds.) 1999; U.S. Pat. No. 4,508,525 to Berger; U.S. Pat. No. 4,920,990 to Lawrence et al.; U.S. Pat. No. 5,101,839 to Jakob et al.; U.S. Pat. No. 5,105,834 to Saintsing et al.; U.S. Pat. No. 5,105,838 to White et al.; and U.S. Pat. No. 5,360,023 to Blakley et al; U.S. Pat. Application 2002/0166563; and European Patent No. 920816. At least one tocopherol compound or derivative thereof can be incorporated in the filter element (e.g., in an amount of about 0.1% to about 0.5%, based on the dry weight of the smokable material within the cigarette). Tocopherol compounds can be incorporated as components of filter elements as dry, ultrafine particles (e.g., particles having diameters of about 1 to about 10 microns).

In one aspect, the present invention relates to reconstituted tobacco materials, and the manufacture and use thereof. Such a reconstituted tobacco material comprises an additive, and the additive can be composed of at least one tocopherol or tocopherol derivative. That is, in addition to any tocopherol and tocopherol derivatives naturally present in tobacco, exogenous tocopherol and tocopherol derivatives are incorporated within the tobacco materials of the present invention. See, for example, Rodgman et al., *Human Exper. Toxicol.,* 19, 575-595 (2000) and Kappus et al., *Free Rad. Bio. Med.,* 13 55-74 (1992).

The additive that is intimately admixed with (e.g., incorporated into) the reconstituted tobacco is a tocopherol compound, that is, a tocopherol or derivative thereof. Tocopherol compounds encompass all natural (e.g., d-alpha-tocopherol) and synthetic (e.g., d-, l-alpha-tocopherol) tocopherol and tocotrienol compounds in all of their isomeric forms, including those compounds commonly referred to as Vitamin E. Certain preferred tocopherol compounds can include monomethyl, dimethyl or trimethyl derivates of tocol having the following Formula I:

Formula I

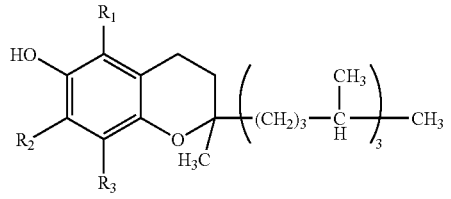

wherein $R_1$, $R_2$, and $R_3$ are each selected from the group consisting of hydrogen and methyl, at least one of which is a methyl group. Exemplary compounds of Formula I include alpha tocopherol (5,7,8-trimethyl tocol), beta-tocopherol (5,8-dimethyl tocol), gamma tocopherol (7,8-dimethyl tocol), delta tocopherol (8-methyl tocol), epsilon tocopherol (5-methyl tocol), zeta tocopherol (5,7-dimethyl tocol), and eta tocopherol (7-methyl tocol). The additive also can include those compounds that are designated RRR-alpha-tocopherol, 2-epi-alpha-tocopherol, 2-ambo-alpha-tocopherol, 4'-ambo-8'-ambo-alpha-tocopherol. The various racimates of alpha-tocopherol (e.g., RRR, RRS, RSS, SSS, RSR, SRS, SRR and SSR), such as those provided as a result of the production of synthetic alpha-tocopherol, also can be employed. See also, for example, Carpenter, in *Vitamins and Cancer Prevention*, Laidlaw et al. (Eds.) p. 61-90 (1991).

It is most preferred that the additive have the form of a tocopherol, rather than a derivative of a tocopherol. Preferred tocopherols present within reconstituted tobacco transfer into mainstream smoke of cigarettes at relatively high levels, and certain tocopherols transfer to mainstream smoke in higher amounts relative to derivatives of tocopherols. In addition, the sensory attributes of tobacco smoke incorporating tocopherols are flavorable; while the sensory attributes of tobacco smoke incorporating tocoopherol derivatives often are not as favorable, due to the off-taste characteristic of certain tocopherol derivatives. Thus, for an additive of the present invention, it is desirable to use essentially all tocopherol; but when mixtures of tocopherol and tocopherol derivatives are used, it is desirable to use more tocopherol than tocopherol derivative (on a weight basis). That is, it is desirable to employ tocopherol derivatives in amounts that are below or not significantly above the threshold levels of those compounds, in order to not introduce attributes that are dissonant to the overall sensory characteristics of tobacco products incorporating those compounds. In certain circumstances, it is highly preferred to incorporate tocopherol compounds (e.g., tocopherols) into tobacco products in amounts sufficient to provide optimum, and even improved, sensory attributes to the tobacco products (e.g., cigarettes) into which those additives are incorporated. Examples of useful tocopherol derivatives are esters, such as tocopherol acetate, tocopherol palmitate, tocopherol linoleate, tocopherol nicotinate, tocopherol sorbate, or tocopherol succinate; ethers, such as polyethylene glycol ethers of tocopherol (e.g., tocophereth-5, tocophereth-10, tocophereth-12, tocophereth-18 or tocophereth-50); and 6-hydroxychroman homologues. See, *Int. J. Toxicol.,* 21(Suppl. 3) 51-116 (2002).

The exogenous tocopherol compound can have the form of a pure compound, such as neat form of tocopherol compound; or can be derived from an unrefined tocopherol compound source, such as a plant oil. Tocopherol compounds are found in many plant oils (e.g., vegetable oils), including wheat germ oil, rice oil, soybean oil, palm oil, sunflower oil, corn oil, peanut oil, palm oil, rapeseed oil, and cottonseed oil. A mixture of an unrefined tocopherol compound source and a neat tocopherol compound can be used.

One type of method for producing a reconstituted tobacco involves the use of paper-making techniques. In a typical paper-making reconstituted tobacco process, tobacco is extracted with water, and the resulting aqueous extract and water insoluble pulp are separated from one another. The pulp portion can be refined to a desired consistency, and formed into a mat or web, much like wood pulp fibers in a traditional paper making process. The aqueous tobacco extract is applied to the mat of insoluble pulp, and the overall resulting mixture is dried to provide a reconstituted tobacco sheet incorporating the tobacco components from which that sheet was derived. Typically, tobacco stems are used in making such a reconstituted tobacco sheet, because the fibrous nature of those stems provides strength and structural integrity to the resulting sheet. See, for example, U.S. Pat. No. 3,398,754 to Tughan; U.S. Pat. No. 3,847,164 to Mattina; U.S. Pat. No. 4,131,117 to Kite; U.S. Pat. No. 4,270,552 to Jenkins; U.S. Pat. No. 4,308,877 to Mattina; U.S. Pat. No. 4,341,228 to Keritsis; U.S. Pat. No. 4,421,126 to Gellatly; U.S. Pat. No. 4,706,692 to Gellatly; U.S. Pat. No. 4,962,774 to Thomasson; U.S. Pat. No. 4,941,484 to Clapp; U.S. Pat. No. 4,987,906 to Young; U.S. Pat. No. 5,056,537 to Brown; U.S. Pat. No. 5,143,097 to Sohn; U.S. Pat. No. 5,159,942 to Brinkley et al.; U.S. Pat. No. 5,325,877 to Young; U.S. Pat. No. 5,445,169 to Brinkley; U.S. Pat. No. 5,501,237 to Young; U.S. Pat. No. 5,533,530 to Young; which are incorporated herein by reference.

Alternatively, a reconstituted tobacco product can be formed using a casting-type process wherein an aqueous tobacco slurry or suspension is poured onto a surface, such as a metal sheet, to form a cast sheet without separating the aqueous extract from the insoluble pulp. The slurry then is heated to evaporate the water and a dry reconstituted tobacco sheet results. Adhesive materials can be incorporated into the slurry in order to provide a tobacco sheet having good strength and structural integrity. See, for example, U.S. Pat. No. 3,353,541 to Hind; U.S. Pat. No. 3,399,454 to Hind; U.S. Pat. No. 3,483,874 to Hind; U.S. Pat. No. 3,760,815 to Deszyck; U.S. Pat. No. 4,674,519 to Keritsis; U.S. Pat. No. 4,972,854 to Kiernan; U.S. Pat. No. 5,023,354 to Hickle; U.S. Pat. No. 5,099,864 to Young; U.S. Pat. No. 5,101,839 to Jakob; U.S. Pat. No. 5,203,354 to Hickle; U.S. Pat. No. 5,327,917 to Lekwauwa; U.S. Pat. No. 5,339,838 to Young; U.S. Pat. No. 5,598,866 to Jakob; U.S. Pat. No. 5,715,844 to Young; U.S. Pat. No. 5,724,998 to Gellatly; and U.S. Pat. No. 6,216,706 to Kumar; and EPO 565360; EPO 1055375 and PCT WO 98/01233; which are incorporated herein by reference.

Additional exemplary methods of processing reconstituted tobacco material are set forth in U.S. Pat. No. 4,880,018 to Graves; U.S. Pat. No. 5,025,812 to Fagg; U.S. Pat. No. 5,065,775 to Fagg; U.S. Pat. No. 5,072,744 to Luke; U.S. Pat. No. 5,131,414 to Fagg; U.S. Pat. No. 5,234,008 to Fagg; U.S. Pat. No. 5,360,022 to Newton; U.S. Pat. No. 5,829,453 to White; and U.S. Pat. No. 6,182,670 to White; which are incorporated herein by reference.

The reconstituted tobacco material of the present invention can be prepared according to any of the above-described processes, including any cast sheet or paper making process known in the art. Most preferably, reconstituted tobacco materials are provided using a liquid having an aqueous character. For example, aqueous tobacco extracts and slurries can be formed by mixing a liquid having an aqueous character with a tobacco material. Such a liquid can consist primarily of water, normally greater than about 90 percent water by weight, and can be essentially pure water. For example, the liquid can be distilled or de-ionized water, tap water, or the like. The water mixed with the tobacco material to form the aqueous composition may include minor amounts of various additives known in the art, such as surfactants, organic solvents or humectants.

Tocopherol compounds typically are viscous oils that are relatively insoluble in water. In order to improve aqueous compatibility of tocopherol compounds, a suitable liquid can be added to a tocopherol or tocopherol derivative prior to incorporation of that component into the reconstituted tobacco. That is, tocopherol compounds, optionally formulated with a liquid carrier, solvent or dispersant, can be added to a reconstituted tobacco material or a component thereof during or after its manufacture. Exemplary liquids can include ethanol, benzyl alcohol, glycerol, propylene glycol, acetic acid, and the like. Other exemplary carriers, solvents and dispersants are plant oils into which the tocopherol compounds that are dissolved or dispersed are compatible. However, the use of such liquid carriers, solvents or dispersants is unnecessary; as tocopherol compounds readily are dispersed in aqueous tobacco extracts (e.g., with suitable moderate mixing) without the necessity of formulating the tobacco compound within such a carrier, solvent or dispersant. That is, for carrying out the present invention, tocopherol compounds, in the amounts used and under the conditions that they normally are employed, can be dispersed within aqueous tobacco extracts and slurries.

The manner in which the tocopherol compound is added or applied to the reconstituted tobacco or component thereof can vary. Manners and methods for incorporating additive materials into reconstituted tobaccos during the manufacture of those reconstituted tobaccos will be apparent to those skilled in the art of tobacco processing. Generally, any method that brings the tocopherol compound into intimate contact with the reconstituted tobacco such that the tocopherol compound is dispersed within the tobacco material and allowed to penetrate the tobacco material can be employed. It is preferable to use tocopherol compounds in liquid form (e.g., either in a diluted form or as a thick oil) when carrying out the method of the present invention, although dry powdered forms of tocopherol compounds can be used. The additive can be applied to the reconstituted tobacco after the reconstituted tobacco has been formed. However, it is most preferred that the additive can be incorporated into the reconstituted tobacco during the preparation of that reconstituted tobacco material.

Aqueous tobacco extracts and slurries can possess varying amounts of water. Typically, the amount of water in such extracts and slurries does not exceed about 95%, based on the total weight of the aqueous extract or slurry. Frequently, the amount of water in such extracts and slurries is at least about 50%, often at least about 60%, generally at least about 70%, and typically at least about 80%, based on the total weight of the aqueous extract or slurry. Extracted components of tobacco are those that are soluble within the aqueous liquid. Typically, about 50% of the weight of tobacco that is mixed with an aqueous liquid in extraction or slurry-forming processes is soluble or highly dispersible in that liquid.

If the pulp and aqueous extract are separated, as in a paper making process, the tocopherol compound can be added to either the aqueous extract or the pulp prior to recombining the pulp and extract to form the solid reconstituted tobacco sheet. If a casting-type of process is employed, the tocopherol compound can be added to the slurry of tobacco and water that is provided in carrying out such a process. When a tobacco slurry is formed in the reconstituted tobacco production process, such as in a cast sheet process, the tocopherol compound can be added directly to the tobacco slurry, preferably while the slurry is agitated or mixed to encourage uniform dispersal of the additive throughout the slurry. It is preferable to add the tocopherol compound prior to final drying of the reconstituted tobacco product to the desired final moisture level, which is typically about 12% to about 13%, based on the total weight of that reconstituted tobacco material.

The tocopherol or derivative thereof can be added to an aqueous tobacco slurry, or to an aqueous tobacco extract after that extract has been separated from the insoluble pulp in a paper making process, preferably with some form of mixing or agitation in order to disperse the tocopherol compound uniformly throughout the slurry or extract. Typically, the storage life of such an aqueous tobacco slurry or aqueous tobacco extract is relatively short. Aqueous tobacco extracts that are not recombined with tobacco pulp within relatively short periods of time, or aqueous tobacco slurries that are not subjected to further processing steps, begin to undergo biological degradation, such as fermentation. Addition of tocopherol compound in effective amounts to an aqueous tobacco slurry or an aqueous tobacco extract lengthens the storage life of the extract (e.g., by forestalling the fermentation process, and inhibiting the formation of mold).

Alternatively, the tocopherol compound can be applied to the solid reconstituted tobacco material after the sheet is formed, either while the reconstituted tobacco material is in sheet form or after the sheet is cut into cut filler or particulate form (e.g., shredded). When the tocopherol compound is being added to a solid sheet of material or to a shredded or particulate solid material, spraying is a preferred technique. For example, the additive can be applied (e.g., sprayed as part of a liquid formulation or dispersion) onto the reconstituted tobacco material. In the case of a shredded or particulate reconstituted tobacco material, it is preferable to agitate or mix the tobacco material while the tocopherol compound is being added to encourage uniform dispersal of the additive throughout the tobacco material. Other manners and methods for incorporating additive materials into reconstituted tobaccos during the manufacture of those reconstituted tobaccos will be apparent to those skilled in the art of tobacco processing.

The additive can be applied as part of a casing formulation. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin. The additive can be applied as part of a top dressing formulation. See, for example, U.S. Pat. No. 4,449,541 to Mays et al. The additive can be added to the tobacco blend incorporating reconstituted tobacco using the types of equipment described in U.S. Pat. No. 4,995,405 to Lettau or that are available as Menthol Application System MAS from Kohl Maschinenbau GmbH.

The amount of tocopherol or derivative thereof added to the reconstituted tobacco material can vary. Frequently, sufficient exogenous tocopherol compound is added to the reconstituted tobacco to achieve a final concentration in the reconstituted tobacco of at least about 0.1%, often at least about 0.5%, typically at least about 1%, and typically at least about 2%, based on the final dry weight of the reconstituted tobacco. In certain circumstances, the amount of exogenous tocopherol compound present within a reconstituted tobacco is at least about 3%, and even at least about 4%, based on the final dry weight of the reconstituted tobacco. Frequently, sufficient exogenous tocopherol compound is added to the reconstituted tobacco to achieve a final concentration in the reconstituted tobacco material that does not exceed about 12%, often does not exceed about 10%, typically does not exceed about 8%, and typically does not exceed about 6%, based on the final dry weight of the reconstituted tobacco. Methods for determining the amount of tocopherol compounds in tobacco are set forth in Risner, *Tob. Sci.,* 41:53-61 (1997).

Reconstituted tobacco materials of the present invention can be incorporated into various components of smoking articles, such as cigarettes. Most preferably, the reconstituted tobaccos incorporating additive components (e.g., that are used as components of tobacco blends) are heated or burned to generate smoke for delivery to a smoker.

Reconstituted tobacco materials of the present invention also can be employed as a component of the smokable material used in cigarettes, such as those described in U.S. Pat. No. 4,793,365 to Sensabaugh; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,065,776 to Lawson; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols, et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology,* 12:5, p. 1-58 (2000).

Reconstituted tobaccos can be used as a filter element or incorporated into the filter element, such as in the manner set forth in U.S. Pat. No. 4,889,143 to Pryor; U.S. Pat. No. 4,924,887 to Raker and U.S. Pat. No. 5,025,814 to Raker. Reconstituted tobaccos of the invention also can be used as wrapping materials for smoking articles, such as in the manner set forth in U.S. Pat. No. 5,074,321 to Gentry et al.; U.S. Pat. No. 5,159,944 to Arzonico et al.; U.S. Pat. No. 5,261,425 to Raker; U.S. Pat. No. 5,462,073 to Bowen; and U.S. Pat. No. 5,699,812 to Bowen.

The amount of exogenous tocopherol compound in a smoking article, such as a cigarette, can vary, depending upon factors such as the amount of the reconstituted tobacco that is used and the manner in which the reconstituted tobacco is incorporated into the smoking article (i.e., as a part of the smokable material, as part of the filter, or as part of the wrapping material). Typically, for cigarettes such as those having about 0.6 g to about 1 g of smokable material per rod, about 0.1% to about 6%, preferably about 1% to about 4%, of exogenous tocopherol compound is present in the smoking article as part of the smokable material, based on the total dry weight of the smokable material in the cigarette. In embodiments wherein the reconstituted tobacco is incorporated into the filter element of the smoking article, about 1% to about 8%, preferably about 3% to about 6%, of exogenous tocopherol compound is present in the smoking article, based on the total dry weight of the smoking article. In embodiments wherein the reconstituted tobacco is incorporated into a wrapper material of the tobacco rod of a smoking article, about 0.5% to about 2%, preferably about 0.75% to about 1%, of exogenous tocopherol compound is present in the smoking article, based on the total dry weight of the smoking article.

The reconstituted tobacco of the present invention preferably is blended with other tobacco materials to form a tobacco blend or smokable blend. For example, tobacco blend can comprise the reconstituted tobacco of the present invention and flue-cured tobacco, burley tobacco, Oriental tobacco, and certain processed tobacco products, such as expanded tobacco filler and other reconstituted tobacco materials. The amount of reconstituted tobacco within a smokable blend can be such that the reconstituted tobacco comprises virtually all of the tobacco within that blend. The amount of reconstituted tobacco of the present invention within a smokable blend typically is at least about 5%, frequently is at least about 10%, and often is at least about 20%, of the total weight of that blend. The amount of reconstituted tobacco of the present invention within a smokable blend typically does not exceed about 80%, frequently does not exceed about 75%, and often does not exceed about 70%, of the total weight of that blend. An exemplary smokable blend for cigarettes can incorporate about 25% to about 60% reconstituted tobacco, based on the total weight of that blend.

Tocopherol compounds, such as d-alpha tocopherol, can be naturally present in various tobaccos in various amounts. For example, representative amounts of endogenous d-alpha tocopherol in certain flue-cured tobaccos, burley tobaccos, Oriental tobaccos, reconstituted tobacco sheets and expanded tobacco filler (e.g., in a mixture of 65% flue-cured and 35% burley expanded tobacco) are 447, 124, 174, 74, and 238 μg/cigarette, respectively. The concentrations of d-alpha tocopherol in mainstream smoke from representative straight grade cigarettes made from those representative types of tobaccos, and smoked under FTC smoking conditions, are 59.6, 21, 23, 6, and 16 μg/cigarette, respectively. Thus, relatively high levels of endogenous d-alpha tocopherol present in the tobacco of cigarettes can transfer into the mainstream smoke of those cigarettes.

When the smoking article is employed, the tocopherol additive is transferred into mainstream smoke generated during use of that smoking article. Typically, the transfer of the tocopherol compound into smoke during use of a smoking article incorporating such an additive is greater for tocopherols than for derivatives of tocopherols. For example, when a cigarette incorporating tocopherol additive is smoked under FTC smoking conditions, the amount of transfer of tocopherol additive is typically about 1% to about 20%, generally about 2% to about 15%, and often about 3% to about 12%, based on the total weight of such additive available for transfer within such a cigarette. Typically, for mainstream smoke condensate collected when such cigarettes are smoked under FTC smoking conditions, the amount of tocopherol compound in the "tar" of such cigarettes frequently is about 1% to about 30%, often is about 5% to about 20%, typically is about 8% to about 15%, of the total dry weight of that "tar."

EXPERIMENTAL

The following examples are provided in order to further illustrate various aspects of the invention but should not be construed as limiting the scope thereof. Unless otherwise noted, all parts and percentages are by weight.

Example 1

Manufacture of a Reconstituted Tobacco Material having d-, l-Alpha Tocopherol Added to Aqueous Tobacco Extract A reconstituted tobacco material is provided using a papermaking process generally as described with reference to FIG. 1 of U.S. Pat. No. 5,159,942 to Brinkley et al., using a blend of tobacco types. The blend includes a blend of about 65 parts burley and flue-cured tobacco stem pieces and about 35 parts of a blend of tobacco laminae processing by-products.

The tobacco blend is extracted batch wise at about 130° F. using about 10 to about 15 parts tap water for each part tobacco material. Aqueous tobacco extract is separated from the water insoluble pulp using a centrifuge. The aqueous extract so provided has a soluble solids content of about 5%. The resulting extract is concentrated to a soluble solids content of about 22% to about 28% using a wiped film evaporator. Then, d-, l-alpha tocopherol is contacted with the resulting mixture in a batch wise manner.

The pulp, which has a very low remaining water extractables content, is provided as a slurry in water at a solids content of about 2% to about 3% and refined in a conical refiner to a Canadian Standard Freeness of about 50 to about 200 ml. The refined slurry is diluted using recirculated forming water from the papermaking process to provide a diluted slurry having a solids content of about 0.5% to about 1%. The diluted slurry is formed into a sheet on a fabric belt of a papermaking apparatus, the operation of which will be apparent to the skilled artisan. The pulp is formed into a sheet having a dry basis weight of about 40 to about 50 g/m$^2$. A vacuum is pulled on the bottom of the fabric belt as is common in the papermaking industry so as to provide a damp, formed pulp having a moisture content of about 85%. The formed pulp is passed through a felt roller press to provide a damp pulp having a moisture content of about 85%. The formed pulp is passed once through a Yankee dryer to provide a damp pulp having a moisture content of about 60% to about 65%.

The previously described liquid extract and d-, l-alpha tocopherol mixture is vigorously mixed or homogenized, and sprayed onto one side of the sheet which is formed from the insoluble pulp. The sheet then is subjected to convection heating at greater than about 300° F. to dry the sheet to a moisture content of about 55% to about 70%. Then, the previously described extract and d-, l-alpha tocopherol mixture is sprayed onto the other side of the sheet. Convection drying of the sheet is continued until the moisture content of the reconstituted tobacco sheet is about 12% to about 13%. Sheet then is cut into strip form (e.g., large pieces of about 2 inches by about 4 inches).

The resulting reconstituted tobacco material exhibits a d-, l-alpha tocopherol content of about 4%, a pulp content of about 59%, and a tobacco extract content of about 37% (on a dry weight basis). The tocopherol compound is in intimate contact with the reconstituted tobacco material. The reconstituted tobacco material has a dry weight basis weight of about 90 g/m$^2$, and a thickness approximating that of aged tobacco leaf laminae (e.g., about 400 microns). The reconstituted tobacco material in strip form is shredded into cut filler form (e.g., at about 32 cuts per inch), and blended with other smokable materials for use as a cut filler blend for cigarettes.

Example 2

Cigarettes Comprising a Tobacco Blend Including Reconstituted Tobacco Containing d-, l-Alpha Tocopherol Cigarettes are prepared using the type of reconstituted tobacco sheet described in Example 1. Specifically, two types of reconstituted sheet are provided; one sheet having an analyzed d-, l-alpha tocopherol content of about 1.7%, and the other sheet having an analyzed d-, l-alpha tocopherol content of about 3.3%. Two American blends of tobacco are provided, and each type of reconstituted tobacco sheet is used as a component of each respective blend; that is, one type of reconstituted tobacco sheet is used as a component making up about 50% of a first American tobacco blend, and the other type of reconstituted tobacco sheet is used as a component making up about 50% of a second American tobacco blend.

The cut tobacco filler employed in providing the tobacco rods of cigarettes has the form of strands cut at about 32 cuts per inch. The American blend portion of the final blend contains about 17% burley tobacco, about 34% flue-cured tobacco, about 21% reconstituted tobacco material having no added tocopherol compound, and about 16% Oriental tobacco. The American blend has about 7% of an aqueous casing of glycerin and flavors applied thereto prior to cutting into filler form. About 5% expanded tobacco filler composed of about 65% flue-cured and 35% burley tobacco, then is added to the cut tobacco American blend prior to prepare the final cut filler. The two final blends are prepared by mixing the cut American blend portion with the each of the reconstituted tobacco sheet cut filler containing d-, l-alpha tocopherol; one of each of the two types of reconstituted tobacco sheet being added to each blend. The first mixed final blend has a d-, l-alpha tocopherol content of about 0.8%, and the second mixed final blend has a d-, l-alpha tocopherol content of about 1.7%. Each blend is equilibrated to final moisture of about 12.8% prior to cigarette manufacture.

Each final tobacco blend is used to prepare cigarettes having lengths of about 84 mm and circumferences of about 24.85 mm. The tobacco rod lengths are about 57 mm and filter element lengths are about 27 mm. The tobacco rod included a charge of tobacco cut filler weighing about 0.650 g contained in a circumscribing cigarette paper wrap that has been available as Reference No. 854 cigarette paper from Ecusta Corp. Virtually all of the smokable material within the cigarette is tobacco of some form, and the tobacco blend is absent of non-tobacco fillers or tobacco substitute materials. The filter element is manufactured using conventional cigarette filter making technology from cellulose acetate tow (2.7 denier per filament, 35,000 total denier) plasticized using triacetin, and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod.

Cigarettes so described are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is about 24% air diluted.

Visual inspection of the cigarettes indicates that there is no noticeable spotting and staining of the cigarette paper wrap resulting from the exogenous d-, l-alpha tocopherol present within the tobacco blends of those cigarettes. The cigarettes are smoked under FTC smoking conditions. The cigarette incorporating the higher amount of exogenous tocopherol compound yields about 7.8 mg FTC "tar," and the collected mainstream smoke of that cigarette possesses about 0.8 mg d-, l-alpha tocopherol. The cigarette incorporating the lesser amount of exogenous tocopherol compound yields about 7.6 mg FTC "tar," and the collected mainstream smoke of that cigarette possesses about 0.4 mg d-, l-alpha tocopherol.

Example 3

Incorporation of d-, l-Alpha Tocopherol into an Aqueous Tobacco Extract

Into a beaker containing about 12 g of palm oil is introduced about 20 g of neat alpha-tocopherol. The palm oil and tocopherol are miscible with one another. The resulting mixture is heated slightly, over a range of about 25° C. to about 32° C. About 80 g of an aqueous tobacco extract (i.e., about 40 g water and about 40 g tobacco extract) are introduced into the beaker containing the palm oil and neat tocopherol solution. This resulting mixture is heated to about 85° C. (e.g., a representative temperature of an aqueous tobacco extract prior to application onto tobacco base web in a paper-making type of reconstitution process). The total content of tocopherol compounds in the tobacco extract is about 19%. The total tocopherols from the palm oil in the tobacco extract are about 1.1%, and the total amount of added alpha-tocopherol in the aqueous tobacco extract is about 17.9%.

The tobacco extract containing the palm oil and tocopherol so formed has no residual pulp fragments, and has a form that is suitable for ready application to tobacco base web after mixing. As such, there is provided an effective way to introduce tocopherol compounds into tobacco extracts for the production of reconstituted sheet material. The palm oil also enhances the solubility of neat tocopherol compound in and aqueous tobacco extract. The palm oil also acts to provide for low amounts of residual tocopherol compounds in containers, spray nozzles, piping, dryers, and other machinery associated with tobacco extract and reconstituted tobacco processing and manufacture that may come into contact with such tocopherol compounds. Machinery clean up can be carried with only hot water, and the addition of other solvents (for example, ethanol or dilute acetic acid) are unnecessary.

Example 4

Effect of Tocopherol Compounds on Storage Stability of Aqueous Tobacco Extracts A blend consisting of about 65 parts burley and flue-cured tobacco stem pieces and about 35 parts of tobacco laminae processing by-products is used to prepare a reconstituted tobacco material as in Example 1.

The tobacco blend is extracted batch wise at about 130° F. using about 10 to about 15 parts tap water for each part tobacco material. Aqueous tobacco extract is separated from the water insoluble pulp using a centrifuge. The aqueous extract so provided has a soluble solids content of about 5%. The resulting extract is concentrated to a soluble solids content of about 22% to about 28% using a wiped film evaporator. The prepared extract is divided into two portions. To one portion, d-, l-alpha tocopherol is contacted with the resulting mixture (the test extract). The amount of d-, l-alpha tocopherol added was approximately 4% based on weight of dried solids in the concentrated liquid tobacco extract. In the other portion, no d-, l-alpha tocopherol is added, and as such a control extract is provided.

The concentrated liquid tobacco extracts with and without added d-, l-alpha tocopherol mixture are vigorously mixed or homogenized and allowed to set at room temperature conditions for five days. The d-, l-alpha tocopherol was emulsified in the tobacco extract. There was no separation of the d-, l-alpha tocopherol in the test extract over the five day test period. Within two days the control liquid tobacco extract began to ferment and produce off gasses. The control extract without d-, l-alpha tocopherol became malodorous, discolored and was not useful for application onto the pulp base web for preparation of the final reconstituted tobacco sheet material. The test extract with d-, l-alpha tocopherol, remained unchanged over the five day period and was acceptable for application to the pulp base web for preparation of the final reconstituted tobacco sheet material.

The extracts with and without d-, l-alpha tocopherol was tested for bacterial growth. d-, l-alpha tocopherol was found to significantly reduce bacteria activity in the test extract.

Example 5

Manufacture of a Reconstituted Tobacco Material with d-, l-Alpha Tocopherol Added to Water Insoluble Tobacco Pulp Sheet Portion A reconstituted tobacco material is provided essentially as described in Example 1; however d-, l-alpha tocopherol is not incorporated into the extract. After the pulp sheet is formed and prior to application of the tobacco extract, d-, l-alpha tocopherol is sprayed onto the moist pulp sheet, prior to the time that the sheet enters the dryer region of the paper-making apparatus. The amount of d-, l-alpha tocopherol applied is sufficient to provide a finished sheet having a dry weight of d-, l-alpha tocopherol of 4%. Convection drying of the sheet is continued and the pulp sheet containing d-, l-alpha tocopherol is sprayed with the previously described liquid tobacco extract onto one side of the sheet formed from the insoluble pulp. The sheet then is subjected to further convection heating at greater than about 300° F. to dry the sheet to a moisture content of about 55 to about 70%. Then, the previously described tobacco extract is sprayed onto the other side of the sheet. Convection drying of the sheet is continued until the moisture content of the reconstituted tobacco sheet is about 12 to about 13%. As such, the tocopherol compound is provided in intimate contact with the reconstituted tobacco.

Example 6

Manufacture of a Reconstituted Tobacco Material with d-, l-Alpha Tocopherol Added to Reconstituted Tobacco Strip Material as a Casing A reconstituted tobacco material is provided essentially as described in Example 1; however d-, l-alpha tocopherol is not incorporated into the extract. A 6000 g lot of untreated reconstituted tobacco sheet material in strip form is placed into a warm stainless steel tumbling drum that was previously heated by air at about 160° F. A sufficient amount of hot water is sprayed onto the tumbling warmed reconstituted tobacco such that the resulting tobacco moisture is approximately 20%. A solution of 180 g of d-, l-alpha tocopherol in 800 ml of ethanol is prepared. Hot air at about 160° F. is passed into the tumbling drum to begin drying the reconstituted tobacco. At the same time, the d-, l-alpha tocopherol-ethanol solution is sprayed onto the warm tumbling reconstituted tobacco. As the d-, l-alpha tocopherol-ethanol solution is sprayed onto the warm moist reconstituted tobacco the ethanol solvent is evaporated along with water. In this manner the d-, l-alpha tocopherol is allowed to come into intimate contact with reconstituted tobacco (e.g., the d-, l-alpha tocopherol is allowed to penetrate into the reconstituted tobacco). The reconstituted sheet containing the d-, l-alpha tocopherol is dried to about 12% to about 13%. The d-, l-alpha tocopherol content of the reconstituted sheet is about 3%.

Example 7

Cigarettes Comprising a Tobacco Blend Including Reconstituted Tobacco Containing d-, l-Alpha Tocopherol Cigarettes are prepared using the reconstituted tobacco sheet material of the type described in Example 6. A final blend of tobacco is prepared incorporating 50% by weight of the 3% d-, l-alpha tocopherol reconstituted sheet in cut filler form, and 50% by weight of an American blend of tobacco cut filler. The filler materials employed in providing the tobacco rod are in the form of strands cut at about 32 cuts per inch. The American blend portion of the final blend contained about 17% burley tobacco, about 34% flue-cured tobacco, about 21% reconstituted tobacco material not having any exogenous tocopherol compound applied thereto, and about 16% Oriental tobacco. The American blend has about 7% of an aqueous casing of glycerin and flavors applied thereto prior to cutting into filler form. About 5% expanded tobacco filler, composed of about 65% flue-cured and 35% burley tobacco, then is added to the cut tobacco American blend prior to prepare the final cut filler. The final blend is prepared by mixing the cut reconstituted tobacco sheet containing 3% by weight d-, l-alpha tocopherol to the cut American blend portion. The mixed final blend had a d-, l-alpha tocopherol content of about 1.5% and is equilibrated to final moisture of 12.8% prior to cigarette manufacture.

A control cigarette is prepared as previously set forth, except that no d-, l-alpha tocopherol is applied to either of the reconstituted tobacco sheet materials used in the final tobacco blend. The mixed final blend having no added d-, l-alpha tocopherol is equilibrated to final moisture of 12.8% prior to cigarette manufacture.

Each final tobacco blend is used to prepare cigarettes having lengths of about 84 mm and circumferences of about 24.85 mm. The tobacco rod lengths are 57 mm and filter element lengths are 27 mm. Each tobacco rod includes a charge of tobacco cut filler weighing about 0.650 g contained in a circumscribing cigarette paper wrap that has been available as Reference No. 854 cigarette paper from Ecusta Corp. The filter element is manufactured using conventional cigarette filter making technology from cellulose acetate tow (2.7 denier per filament, 35,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod.

Cigarettes so described are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and were provided using a Laboratory Laser Perforator from Hauni-Werke Korber & Co. KG. The perforated cigarette is about 24% air diluted. Visual inspection of the two types of cigarettes indicates that there is no spotting and staining in either sample.

The compositions of the tobacco blends of each of the cigarettes are comparable, except that the control blend has no added tocopherol compound. The control blend contains about 0.1% endogenous d-alpha tocopherol, while the representative blend contains about 1.64% exogenous d-, l-alpha tocopherol. The cigarettes are smoked under FTC smoking conditions, and the overall compositions of the mainstream smoke of those cigarettes are comparable; except that the smoke yield of alpha tocopherol and FTC tar of the control cigarettes are below detection limits and about 10 mg/cigarette, respectively, and the smoke yield of d-, l-alpha tocopherol and FTC tar of the representative cigarettes are about 0.85 mg/cigarette and about 11 mg/cigarette, respectively. The difference in tar yield is believed to be attributed to the increased yield of d-, l-alpha tocopherol in the representative cigarette.

Smoke condensate of the two types of cigarettes are subjected to Ames testing using strains TA 98 and TA 100 with S-9 activation, and the results are generally comparable. Neutral red analyses of smoke condensates of two types of cigarettes indicates that the smoke condensate from the representative cigarette is significantly less cytotoxic than the control. See, *Chemical and Biological Studies on New Cigarette Prototypes that Heat Instead of Burn Tobacco*, R. J. Reynolds Tobacco Company Monograph (1988).

Example 8

Cigarettes Comprising a Tobacco Blend Including Reconstituted Tobacco Containing d-, l-Alpha Tocopherol Cigarettes having lengths of about 84 mm and circumferences of about 24.85 mm have tobacco rod lengths of 57 mm and filter element lengths of 27 mm were used. The tobacco rod includes a charge of tobacco cut filler weighing about 0.650 g contained in one of two different circumscribing cigarette paper wraps. One cigarette wrapper has been available as Reference No. 854 cigarette paper by Ecusta Corp. The second cigarette wrapper, prepared by Ecusta Corp. and coded AKD0010281, contains about 0.5% an alkylketene dimer additive sold as Aquapel by Hercules Corp. The filter element is manufactured using conventional cigarette filter making technology from cellulose acetate tow (2.7 denier per filament, 35,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod.

Cigarettes so described are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is 19% air diluted.

A blend of tobacco strip is split into two parts. The initial tobacco filler material (in strip form) includes a blend of about 17% burley tobacco, about 34% flue-cured tobacco, about 21% reconstituted tobacco material, and about 16% Oriental tobacco. One blend part has about 7% of an aqueous casing of glycerin and flavors is applied thereto prior to cutting into filler form. The other blend part is similarly cased, but with d-, l-alpha tocopherol present as a component of the casing mixture that is applied thereto, such that the resulting blend has a d-, l-alpha tocopherol content of about 2%. As such, d-, l-alpha tocopherol is applied to the reconstituted tobacco of the blend, as well as other components of the blend. Other blend parts can be provided by casing blend portions with casing formulations containing the desired amounts of tocopherol compound (e.g., in order to provide a resulting blend having a d-, l-alpha tocopherol content of about 1%). The d-, l-alpha tocopherol cased onto the tobacco strips is heated to about 150° F. and sprayed onto the tobacco prior to cutting. Both cased strip blends are cut at about 28 cuts per inch into filler form.

About 5% expanded tobacco is then added to both of the cut tobacco blends to prepare the final cut filler blends. The expanded tobacco is composed of about 65% flue-cured and 35% burley tobacco. The tobacco blends are conditioned to about 12.75% moisture.

Cigarettes incorporating the paper wrapper incorporating the alkylketene dimer and the tobacco blend possessing about 2% tocopherol compound exhibited less visible spotting and staining of that wrapper than did cigarettes possessing a comparable blend but the Reference No. 854 cigarette paper wrapper. Comparable cigarettes prepared using cased blends incorporating about 1% tocopherol compound, about 2% tocopherol compound, and no exogenous tocopherol compound, all are adjudged to possess acceptable sensory attributes, when those cigarettes are smoked. Cigarettes prepared using the cased blend incorporating about 2% tocopherol compound, is adjudged as having attributes of harshness, hot sensation, bitter aftertaste and overall aftertaste that are reduced relative to the other comparable cigarettes possessing lesser levels of exogenous tocopherol compound.

Example 9

Cigarettes Comprising a Tobacco Blend Including Reconstituted Tobacco Containing d-, l-Alpha Tocopherol Cigarettes having lengths of about 84 mm and circumferences of about 24.85 mm have tobacco rod lengths of 57 mm and filter element lengths of 27 mm. The tobacco rod includes a charge of tobacco cut filler weighing about 0.650 g contained in a circumscribing cigarette paper wrap that has been available as Reference No. 854 cigarette paper by Ecusta Corp. The filter element is manufactured using conventional cigarette filter making technology from cellulose acetate tow (2.7 denier per filament, 35,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod. Cigarettes so described are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is 20% air diluted.

The filler material employed in providing the tobacco rod is in the form of strands cut at about 32 cuts per inch. The initial filler material includes a blend of about 17% burley tobacco, about 34% flue-cured tobacco, about 21% reconstituted tobacco material possessing no exogenous tocopherol compound, and about 16% Oriental tobacco. The blend has about 7% of an aqueous casing of glycerin and flavors applied thereto. About 5% expanded tobacco is then added to the cut tobacco blend prepared above to prepare the final cut filler. The expanded tobacco is composed of about 65% flue-cured and 35% burley tobacco.

Ethyl alcohol is used as a liquid carrier for d-, l-alpha tocopherol, d-, l-alpha tocopherol acetate and d-, l-alpha tocopherol succinate. Each tocopherol compound is mixed with the ethyl alcohol in the amount of 1 part tocopherol compound to 9 parts ethyl alcohol. Then, cigarettes each having one of the resulting solutions injected therein using a syringe are provided. The syringe is filled with the desired solution and carefully entered into the cigarette rod about 50 mm into the cigarette rod, and the solution is released at a relatively constant rate while withdrawing the syringe from the cigarette. Thus, the solution was applied relatively uniformly over about 45 mm of the tobacco rod. The cigarettes are allowed to dry for about 24 hours between successive injections, and the syringe injection procedure is repeated until the desired amount of d-, l-alpha tocopherol and/or d-, l-alpha tocopherol ester was incorporated in the cigarette. After the last injection, the cigarettes are placed in a conditioned lab at 70° F. and 60% relative humidity for about 2 days to re-equilibrate. As such, blends incorporating reconstituted tobacco in intimate contact with tocopherol compounds are provided.

The concentration of d-, l-alpha tocopherol in tobacco and smoke are measured, and the transfer rate of d-, l-alpha tocopherol into mainstream smoke is calculated by dividing the amount of d-, l-alpha tocopherol in smoke by the amount of d-, l-alpha tocopherol found in the tobacco.

Cigarettes having blends incorporating d-, l-alpha tocopherol added in the amount of about 1% exhibit transfer of d-, l-alpha tocopherol into mainstream smoke of about 10.3%. Cigarettes having blends incorporating d-, l-alpha tocopherol acetate added in the amount of about 0.5% exhibit transfer of d-, l-alpha tocopherol into mainstream smoke of about 1.6%. Cigarettes having blends incorporating d-, l-alpha tocopherol succinate added in the amount of about 4% exhibit transfer of d-, l-alpha tocopherol into mainstream smoke of about 11.6%. Cigarettes having blends incorporating no added d-, l-alpha tocopherol (i.e., only endogenous tocopherol compound) exhibit transfer of d-alpha tocopherol into mainstream smoke of about 17.4%.

Cigarettes having blends incorporating d-, l-alpha tocopherol added in the amount of about 1% are prepared. Cigarettes having blends incorporating d-, l-alpha tocopherol acetate added in the amount of about 1% are prepared. Cigarettes having blends incorporating d-, l-alpha tocopherol succinate added in the amount of about 1% are prepared. Cigarettes having blends incorporating no added d-, l-alpha tocopherol (i.e., only endogenous tocopherol compound) also are prepared. The cigarettes having added d-, l-alpha tocopherol and no added d-, l-alpha tocopherol are smoked, and are observed to have similar sensory attributes and are perceived as being comparable. The cigarettes having blends incorporating the added d-, l-alpha tocopherol esters are smoked, and are adjudged as having different sensory attributes (e.g., more bitter, sour and more nasal sting) than the cigarettes having added d-, l-alpha tocopherol and no added d-, l-alpha tocopherol.

Example 10

Carbon Filtered Cigarettes Prepared with Tocopherol Compound Top Dressed onto an American Blend Cigarettes having lengths of about 84 mm and circumferences of about 24.85 mm have tobacco rod lengths of 57 mm and filter element lengths of 27 mm. The tobacco rod includes a charge of tobacco cut filler weighing about 0.6 g contained in a circumscribing cigarette paper wrap, which has been available as Reference No. 854 cigarette paper by Ecusta Corp. The filter element is a two-segment carbon paper containing filter of the type described in U.S. Pat. No. 5,360,023 to Blakeley. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod.

Cigarettes so described are manufactured using a Pilot Cigarette Maker from Hauni-Werke Korber & Co. KG. A ring of laser perforations are provided around the periphery of the cigarette about 13 mm from the extreme mouth end thereof. The perforations penetrate through the tipping paper and plug wrap, and are provided using a Laboratory Laser Perforator from Hauni-Werke Korber & Co. KG. The perforated cigarette is 30% air diluted.

The filler material employed in providing the tobacco rod is in the form of strands cut at about 32 cuts per inch. The initial filler material includes a blend of about 13% burley tobacco, about 20% flue-cured tobacco, about 17% reconstituted tobacco material, and about 17% Oriental tobacco. The blend has about 3% of an aqueous casing of glycerin and flavors applied thereto prior to cutting into filler form. About 30% expanded tobacco then is added to the cut tobacco blend prepared above to prepare the final cut filler. The expanded tobacco is composed of about 100 percent flue-cured tobacco.

About 5000 g of the tobacco blend is provided. The cut filler is treated with about 50 g of d-, l-alpha tocopherol additive that has been mixed with either benzyl alcohol or ethyl alcohol (i.e., representative top dressing liquid carriers). As such, components of the blend, including the reconstituted tobacco of that blend, are in intimate contact with the tocopherol compound.

Example 11

Cigarettes Comprising a Tobacco Blend Including Reconstituted Tobacco Containing d-, l-Alpha Tocopherol Cigarettes having lengths of about 84 mm and circumferences of about 24.85 mm have tobacco rod lengths of 57 mm and filter element lengths of 27 mm. The tobacco rod includes a charge of tobacco cut filler weighing about 0.650 g contained in a circumscribing cigarette paper wrap that has been available as Reference No. 854 cigarette paper by Ecusta Corp. The filter element is manufactured using conventional cigarette filter making technology from cellulose acetate tow (2.7 denier per filament, 35,000 total denier) and circumscribing non-air permeable paper plug wrap. The tobacco rod and filter element are aligned in an abutting, end-to-end relationship and secured together using a non-air permeable tipping paper. The tipping paper is adhesively secured to the filter element and the adjacent portion of the tobacco rod. The tipping material circumscribes the length of the filter element at about 3 mm of the length of the tobacco rod. Cigarettes so described are manufactured using a Protos Cigarette Maker from Hauni-Werke Korber & Co. KG equipped the type of apparatus set forth in U.S. Pat. No. 4,995,405 to Lettau. A ring of laser perforations are provided around the periphery of the cigarette about 13 mm from the extreme mouth end thereof. The perforations penetrate through the tipping paper and plug wrap, and are provided using a Laser Perforator from Hauni-Werke Korber & Co. KG. The perforated cigarette is 20% air diluted.

The filler material employed in providing the tobacco rod is in the form of strands cut at about 32 cuts per inch. The initial filler material includes a blend of about 17% burley tobacco, about 34% flue-cured tobacco, about 21% reconstituted tobacco material, and about 16% Oriental tobacco. The blend has about 7% of an aqueous casing of glycerin and flavors applied thereto. About 5% expanded tobacco is then added to the cut tobacco blend prepared above to prepare the final cut filler. The expanded tobacco is composed of about 65% flue-cured and 35% burley tobacco.

Neat d-, l-. tocopherol is applied to the cut filler blend during cigarette manufacture using the type of apparatus set forth in U.S. Pat. No. 4,995,405 to Lettau such that about 1% of the tobacco blend is composed of d-, l-. tocopherol (on a dry weight basis). As such, components of the blend, including the reconstituted tobacco of that blend, are in intimate contact with the tocopherol compound.

The cigarettes are smoked under FTC smoking conditions. The yield of d-, l-alpha tocopherol determined, and the transfer rate of d-, l-alpha tocopherol into mainstream smoke is calculated by dividing the amount of d-, l-alpha tocopherol in collected mainstream smoke by the amount of d-, l-alpha tocopherol found in the tobacco. Cigarettes having blends incorporating the exogenous d-, l-alpha tocopherol exhibit transfer of d-, l-alpha tocopherol into mainstream smoke of about 7%.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of preparing an aqueous tobacco slurry or aqueous tobacco extract having increased storage stability, comprising:

providing a tobacco material;

contacting the tobacco material with an aqueous solution to form the aqueous tobacco slurry such that water-soluble components of the tobacco material are extracted from the tobacco material into the aqueous solution;

optionally, separating at least a portion of the aqueous solution from the tobacco material to form the aqueous tobacco extract;

adding a tocopherol or derivative thereof to the aqueous tobacco slurry or the aqueous tobacco extract such that the storage stability of the aqueous tobacco slurry or the aqueous tobacco extract is increased;

storing the aqueous tobacco slurry or the aqueous tobacco extract for a period of time of at least 5 days following said adding step;

forming a reconstituted tobacco material comprising the stored aqueous tobacco slurry or the stored aqueous tobacco extract; and incorporating the reconstituted tobacco material into a tobacco blend.

2. The method of claim 1, wherein the reconstituted tobacco material comprises at least about 0.1 percent of the added tocopherol or derivative thereof, based on the dry weight of the reconstituted tobacco.

3. The method of claim 1, wherein the reconstituted tobacco material comprises at least about 0.5 percent of the added tocopherol or derivative thereof, based on the dry weight of the reconstituted tobacco.

4. The method of claim 1, wherein the reconstituted tobacco material comprises at least about 1.0 percent of the added tocopherol or derivative thereof, based on the dry weight of the reconstituted tobacco.

5. The method of claim 1, wherein the reconstituted tobacco material comprises at least about 2.0 percent of the added tocopherol or derivative thereof, based on the dry weight of the reconstituted tobacco.

6. The method of claim 1, wherein the reconstituted tobacco material comprises at least about 3.0 percent of the added tocopherol or derivative thereof, based on the dry weight of the reconstituted tobacco.

7. The method of claim 1, wherein the tocopherol or derivative thereof comprises alpha-tocopherol.

8. The method of claim 1, wherein the tocopherol or derivative thereof is in a form selected from the group consisting of a neat compound or an unrefined plant oil.

9. The method of claim 1, wherein the tocopherol or derivative thereof is formulated with a liquid carrier.

10. The method of claim 9, wherein the liquid carrier is selected from the group consisting of plant oils, ethanol, benzyl alcohol, glycerol, propylene glycol, and acetic acid.

11. A method of preparing an aqueous tobacco extract having increased storage stability, comprising:

providing a tobacco material;

contacting the tobacco material with an aqueous solution to form an aqueous tobacco slurry such that water-soluble components of the tobacco material are extracted from the tobacco material into the aqueous solution;

separating at least a portion of the aqueous solution from an insoluble pulp of the tobacco material to form the aqueous tobacco extract;

adding a tocopherol or derivative thereof to the aqueous tobacco extract such that the storage stability of the aqueous tobacco extract is increased;

storing the aqueous tobacco extract for a period of at least five days following said adding step; and forming a reconstituted tobacco material by recombining the insoluble pulp of the tobacco material with the stored aqueous tobacco extract comprising the added tocopherol or derivative thereof.

12. The method of claim 11, wherein the reconstituted tobacco material comprises at least about 0.1 percent of the added tocopherol or derivative thereof, based on the dry weight of the reconstituted tobacco.

13. The method of claim 11, wherein the reconstituted tobacco material comprises at least about 1.0 percent of the added tocopherol or derivative thereof, based on the dry weight of the reconstituted tobacco.

14. The method of claim 11, wherein the reconstituted tobacco material comprises at least about 3.0 percent of the added tocopherol or derivative thereof, based on the dry weight of the reconstituted tobacco.

15. The method of claim 11, wherein the tocopherol or derivative thereof comprises alpha-tocopherol.

16. The method of claim 11, wherein the tocopherol or derivative thereof is in a form selected from the group consisting of a neat compound or an unrefined plant oil.

17. The method of claim 11, wherein the tocopherol or derivative thereof is formulated with a liquid carrier.

18. The method of claim 17, wherein the liquid carrier is selected from the group consisting of plant oils, ethanol, benzyl alcohol, glycerol, propylene glycol, and acetic acid.

* * * * *